US006715300B2

(12) United States Patent
Longsworth

(10) Patent No.: US 6,715,300 B2
(45) Date of Patent: Apr. 6, 2004

(54) PULSE TUBE INTEGRAL FLOW SMOOTHER

(75) Inventor: Ralph C. Longsworth, Allentown, PA (US)

(73) Assignee: IGC-APD Cryogenics, Allentown, PA (US)

( * ) Notice: Subject to any disclaimer, the term of this patent is extended or adjusted under 35 U.S.C. 154(b) by 0 days.

(21) Appl. No.: 09/838,840

(22) Filed: Apr. 20, 2001

(65) Prior Publication Data

US 2002/0152758 A1 Oct. 24, 2002

(51) Int. Cl.[7] ..... F25B 9/00; F28D 17/00
(52) U.S. Cl. ..... 62/6; 165/4
(58) Field of Search ..... 62/6; 165/4

(56) References Cited

U.S. PATENT DOCUMENTS 3,339,627 A * 9/1967 Van Geuns et al. ..... 165/4
3,692,095 A * 9/1972 Fleming ..... 165/4
4,901,787 A * 2/1990 Zornes ..... 165/4
5,746,269 A * 5/1998 Torii ..... 165/4
5,918,470 A * 7/1999 Xu et al. ..... 62/6
5,953,920 A * 9/1999 Swift et al. ..... 62/6
6,032,464 A * 3/2000 Swift et al. ..... 62/6
6,131,644 A * 10/2000 Kohara et al. ..... 62/6

OTHER PUBLICATIONS

An Experimental Study on the Heat Transfer Characteristics of the Heat Exchangers in the Basic Pulse Tube Refrigerator, S. Jeong et al., Cryogenic Engineering Laboratory, pp. 249–251.

* cited by examiner

*Primary Examiner*—William C. Doerrler
(74) *Attorney, Agent, or Firm*—Katten Muchin Zavis Rosenman

(57) ABSTRACT

Several layers of fine mesh screen are diffusion bonded together to form a rigid disc or plate that is self supporting and is a flow smoother at the ends of a pulse tube expander. Layers range from fine screens on the surface facing the pulse tube to coarser screens that provide structural support without significantly adding to pressure drop across the screen assembly. The flow smoother is typically used in series with a heat exchanger at the warm end that rejects heat to ambient from the gas of the pulse tube and a heat exchanger at the cold end that receives heat from the load being cooled.

39 Claims, 5 Drawing Sheets

TABLE I Heat Exchanger Performance

| | Slotted | Screen |
|---|---|---|
| Heat Load -W | 100 | 100 |
| He Flow Rate, avg. for % cycle — g/s | 7.2 | 7.2 |
| He Pressure, avg. - MPa | 1.0 | 1.0 |
| He Temperature, avg. - K | 77 | 77 |
| | | |
| Heat Exchanger Outer Diameter - mm | 42.7 | 43.2 |
| Heat Exchanger Inner Diameter - mm | 4.7 | - |
| Heat Exchanger Length - mm | 30 | 24 |
| Number of Slots | 24 | - |
| Slot Width-mm | .36 | - |
| Wire Diameter-mm | - | .05 |
| | | |
| | | |
| Void Volume — $mm^3$ | **4,800** | **23,500** |
| Pressure Drop - kPa | 0.2 | 0.4 |
| Temperature Difference, gas to surface - K | 2.9 | 0.02 |
| Temperature Difference, center to edge - K | 1.3 | 4.5 |
| Temperature Difference, total - K | 4.2 | 4.5 |

Fig. 4

TABLE II Flow Smoother Performance

| | | |
|---|---|---|
| High pressure- MPa | 2.2 | |
| Low pressure - MPa | 0.8 | |
| Pulse rate - Hz | 2.4 | |
| Stage | 1 | 2 |
| Pulse tube inner diameter - mm | 46 | 19 |
| Pulse tube length - mm | 220 | 460 |
| | | |
| Perforated plate flow smoother | | |
| Plate thickness-mm | 0.5 | 0.5 |
| Holediameter-mm | 0.5 | 0.5 |
| % free area | 20 | 20 |
| #plates | 1 | 1 |
| **Temperature with no heat load - K** | **.26.1** | **3.5** |
| **Temperature with 30/1 XV - K** | **50.1** | **5.4** |
| | | |
| Integral screen flow smoother | | |
| Wire diameter - mm | .05 | .05 |
| % free area | 64 | 64 |
| Thickness - mm | 10 | 8 |
| **Temperature with no heat load - K** | 23.6 | 2.8 |
| **Temperature with 30/1 W - K** | 47.2 | 4.2 |

Fig. 7

PULSE TUBE INTEGRAL FLOW SMOOTHER

BACKGROUND OF THE INVENTION

This invention relates to pulse tube refrigeration systems and more particularly to the construction of a flow smoother for pressurized gas as it enters either the warm or cold end of a pulse tube expander.

One can think of a portion of the gas in a pulse tube as forming a piston that replaces the solid piston in a GM or Stirling expander. This concept is feasible and has been reduced to utilitarian practice if the gas enters the pulse tube alternately at both ends with a uniform flow pattern and very small cells of turbulence. Then flow is laminar and mixing of the gas in the pulse tube is minimized. By "uniform flow" is meant that the velocity of the gas at the tube entrance is substantially uniform over a face area of several square millimeters.

However, gas entering the first and second stages of a two-stage pulse tube system often flows through entrance passages with 90° bends, for example, that tend to produce uneven flow distributions. The flow must be redistributed to a uniform flow for effective pulse tube operation. Prior art flow smoothers include perforated plates, holes drilled in a plate(s) as in U.S. Pat. No. 6,082,117, and sintered spheres, used by the inventor here in early development work on pulse tube expanders. These constructions have been used both as flow smoothers and heat exchangers.

What is needed is a flow smoother upstream of a pulse tube expander that turns turbulent flow into laminar flow so that mixing of gas in a pulse tube is minimized.

SUMMARY OF THE INVENTION

The warm and cold ends of a pulse tube expander should have a structure that promotes uniform flow of the gas entering the tube, with a minimum amount of turbulence. Layers of fine mesh wire screen, for example 200 mesh (200×200 wires/inch), would be desirable at an entrance to the expander, but individual screens are too flexible to be used separately. Therefore, coarser screens, perforated plates, or sintered spheres have been used in earlier development.

The present invention improves upon earlier methods of smoothing the flow by diffusion bonding several layers of fine mesh screen together to form a rigid disc or plate that is self supporting. The design can be refined by having several layers ranging from fine screens on the surface facing the pulse tube to coarser screens that provide structural support without significantly adding to the pressure drop across the screen assembly.

The flow smoother is typically used in series with a heat exchanger at the warm end that rejects heat to ambient from the gas of the pulse tube and a heat exchanger at the cold end that receives heat from the load being cooled. The screen assembly flow smoother can be physically extended in the flow direction to serve this heat exchanger function. Preferably a flow smoother is used in conjunction with a slotted heat exchanger of separate construction that has less void volume and less pressure drop than a screen heat exchanger for a given temperature difference produced by the exchanger.

The desirable characteristics of good heat transfer and uniform flow distribution in a flow smoother and in a heat exchanger come at the cost of pressure drop and void volume. Void volume is that portion of gas in the refrigerating system that is repetitively pressurized and depressurized without any advantage or purpose in operation of the refrigeration system, analagous to the clearance volume in an internal combustion engine cylinder.

Wire screens provide good heat transfer between the gas flow and the screens but the temperature difference between the center of the screens and the edge is large when compared to heat exchangers with a radial slot pattern. The difference between the two geometries increases as the diameter of the heat exchanger increases, favoring the slotted heat exchanger.

For a given overall temperature difference, the slotted heat exchanger has the lowest pressure drop and void volume relative to wire screens, perforated plates, or sintered spheres. Although the flow distribution exiting a slotted heat exchanger is not as good as with the other heat exchanger constructions, when an integral wire screen flow smoother of the present invention is placed between the heat exchanger and the pulse tube, overall properties are optimized.

Thus in accordance with the invention, a flow smoother, constructed of screens that are bonded together to form a self-supporting integral structure, is positioned at each end of a pulse tube expander. At the cold end of the expander, a heat exchanger may be combined with the smoother, positioned down stream of the flow smoother, or may immediately follow the smoother as an independent structure. The flow smoother screens are graded, with the finest mesh screens located on the pulse tube side of the smoother and the coarsest screens on the heat exchanger side.

A slotted heat exchanger that follows the flow smoother provides good heat transfer, low-pressure drop, and minimal void volume. That is, the flow smoother is positioned between the pulse tube and the heat exchanger. The slotted exchanger also helps to distribute the gas flow so that the flow smoother does not have to be as thick in the flow direction to provide uniform flow as compared to performance with other heat exchanger geometries.

Slotted heat exchangers have been described previously in a paper by G. Thummes et al, titled "Effect of Pressure Wave Form on Pulse Tube Refrigerator Performance" in Cryocoolers 8, pages 383–393, Plenum Press, New York 1995.

Accordingly, an object of the present invention is to provide an improved flow smoother for a pulse tube expander by maintaining uniform flow entering the pulse tube and avoiding large scale mixing and circulation of gas.

Another object of the invention is to provide an improved flow smoother having fine mesh screens at the interface between the flow smoother and pulse tube expander to minimize the scale of local turbulence.

A further object of the invention is to provide an improved self-supporting fine screen flow smoother with low pressure drop and little void space for use with a pulse tube expander.

Still other objects and advantages of the invention will be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, references is had to the following description taken in connection with the accompanying drawings in which:

FIG. 4 is Table I comparing performance of a slotted heat exchanger with a stacked wire screen heat exchanger for use with a screen flow smoother in accordance with the invention;

FIG. 7 is Table II comparing performance of pulse tubes with perforated plate flow smoothers and with screen flow smoothers in accordance with the invention.

DESCRIPTION OF PREFERRED EMBODIMENTS

This invention relates to the construction of a flow smoother for the gas as it alternately enters the warm and cold ends of a pulse tube expander. The invention also relates to an option of combining the flow smoother with a heat exchanger to reject heat from the gas at the warm end of a pulse tube and/or transfer heat to the gas at the cold end. The heat exchanger may be combined as a physically integral extension of the flow smoother or be an independent structure. The flow smoother is constructed of fine screens, preferably copper, that are bonded together forming an integral structure that is self-supporting.

Figure 1:
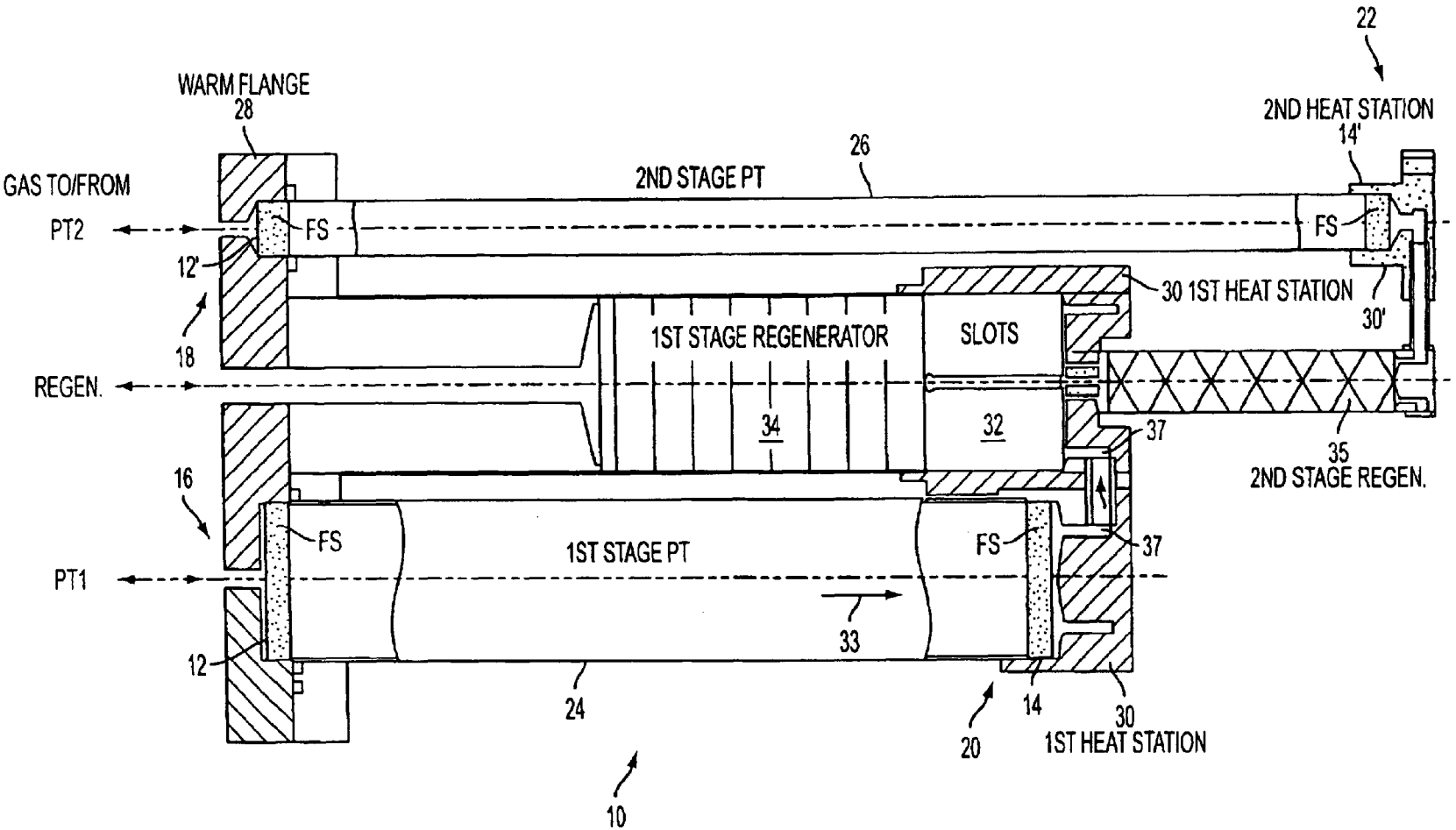
FIG. 1 is a schematic cross section of a two stage GM type pulse tube expander including flow smoothers in accordance with the invention.

FIG. 1 is a cross-section of a two stage GM type pulse tube expander 10 having flow smoothers 12, 12', 14, 14' at the warm ends 16, 18 and cold ends 20, 22 of each of the two pulse tubes 24, 26. The pulse tubes 24, 26 are, for example, stainless steel tubes that are welded or brazed into a warm flange 28, typically stainless steel, and brazed into heat stations 30, 30', typically copper, at the cold ends. At the warm ends 16, 18, an aluminum flange 28 may alternatively be used to hold the flow smoothers 12, 12' and optional heat exchangers (not shown).

Figure 6:
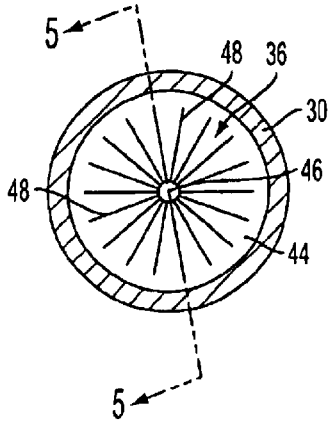
FIG. 6 is a view of the slotted heat exchanger taken along the line 6—6 of FIG. 5.

For the second stage pulse tube 26, heat exchangers (not shown) may be included at both ends as extensions of the flow smoothers 12', 14'. For the first stage pulse tube 24 a slotted type heat exchanger 32, which may have the radial pattern of cuts shown separately in FIG. 6, is connected to the cold end 20 by way of passages 37. The flow smoother 14 and heat exchanger 32 thus are separate structures for the first stage in FIG. 1. Gas flowing, for example, in the direction of arrow 33 leaves the pulse tube 24 through the screen flow smoother 14 and enters the heat exchanger 32 by way of the connecting passages 37.

Two alternative embodiments are illustrated for the first stage cold end heat exchangers, both slotted. The first embodiment (FIG. 1) positions the primary heat transfer surface 32 adjacent the cold end of first stage regenerator 34. In the second embodiment (FIG. 5) the heat transfer surface (heat exchanger) 36 is adjacent the first stage pulse tube 24/flow smoother 14. At the warm end only a flow smoother 12, 12' is illustrated (FIG. 1) for each pulse tube 24, 26 but a slotted heat exchanger (not shown) may be added on the end of the flow smoother 12, 12' away from the expander 24, 26 in another alternative embodiment of the invention.

Figure 2:
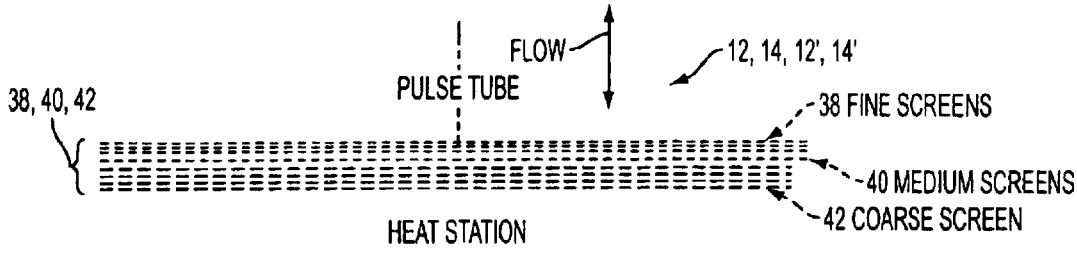
FIG. 2, not to scale, is a cross sectional representation, to an enlarged scale, of the flow path in a screen flow smoother in accordance with the invention.

FIG. 2 shows details of construction of a screen flow smoother 12, 12', 14, 14' in accordance with the invention. The smoother includes a stack of fine wire screens 38, 40, 42 that are bonded together to provide a substantially self supporting rigid structure. Preferably the screens are copper so that they contribute to heat transfer to the sink (flange) 28 at the warm ends 16, 18 and to heat transfer from the loads (heat stations) 30, 30' at the cold ends 20, 22.

Also it is preferred that the screens are graded, as illustrated, with the finest mesh (smallest openings, that is, most wires per unit of flow cross sectional area) screens 38 on the pulse tube side and the coarsest (largest openings) screens 42 on the heat exchanger side of the flow smoother. Additional screens 40 of intermediate openings are positioned between the finer and coarser screens 38, 42.

FIG. 2 illustrates a construction with three fine screens 38, one medium fine screen 40, and four coarser screens 42. It should be understood that the invention is not limited to this construction, the number of screens in each different degree of fineness, may be varied to accommodate the requirements of a particular system and the quantities of gas flow and cross section flow area.

Also, whereas it is a preferred embodiment at this time to have the finer screens 38 (as a first face of the flow smoother) adjacent the associated pulse tube and the coarser screens 42 (as a second face of the flow smoother) farthest away from the associated pulse tube 24, the invention is not limited to such a construction. Generally speaking, the amount of disturbance in the gas flow at the interface between a flow smoother and the pulse tube is directly related to the size of the openings in the first screen closest to the pulse tube. However, under certain flow conditions, improved performance, as compared with the prior art, may still be achieved where the screen closest to the pulse tube has, for example, a coarser structure with large openings, and is then followed with finer screen(s) in series.

Also, there may only be one or two grades of screening in an embodiment in accordance with the invention, and there may be more than the three grades of screening that are illustrated. The coarser screen 42 may be located between the finer screens 38 and the medium screens 40. It should also be understood that within each of the indicated degrees 38, 40, 42 of grading, screens of different fineness (unlike FIG. 2) may be present and may be intermixed.

As stated, a key feature in the flow smoother of the present invention is that the assembly of fine screens, which separately lack dimensional strength and rigidity, is made integral and self-supporting. Thus, the advantages of fine screens accrue to the benefit of a pulse tube system whereas such fine screening by itself may not serve because it lacks rigidity and dimensional stability.

In an alternative embodiment (not shown) in accordance with the invention, a wire felt is bonded together in a pattern that has equivalent properties to wire screen (wire screen is also known as wire cloth for small diameter wires). Wire cloth/screens and felt are commercially available with wire diameter, for example, as small as 0.2 mm, with spacing between the wires approximately the same 0.2 mm. For example, a fine screen may have a 200 mesh, that is, 200 spaced wires per linear inch crossed by another 200 wires per linear inch (200×200). It is currently easier to achieve a uniform flow pattern using screens rather than felt because of the difficulty in maintaining a uniform distribution of wires in the felt.

Use of felt layers and screen layers in the same flow smoother is not precluded, and such constructions are considered to be within the scope of the invention.

Wire screen and felt of suitable construction for use in pulse tube flow smoothers in accordance with the invention are commercially available, for example, from Unique Wire Weaving Company, Inc., Hillside, N.J. 07205-1094.

A clean flow smoother screen assembly can be produced, for example, by diffusion bonding in a vacuum furnace. First, a desired stack of screen layers is formed and placed in the furnace. By controlled operation of the furnace, joining is effected without melting the wires. The wires when heated join by molecular mixing at the contact points between the wires. Other techniques for manufacturing include, but are not limited to, for example, ultrasonic bonding, or using solder coated wires in the screen and then applying heat until the layers join (sintering). After joining, the stacked integral screens are cut to size.

Figure 5:
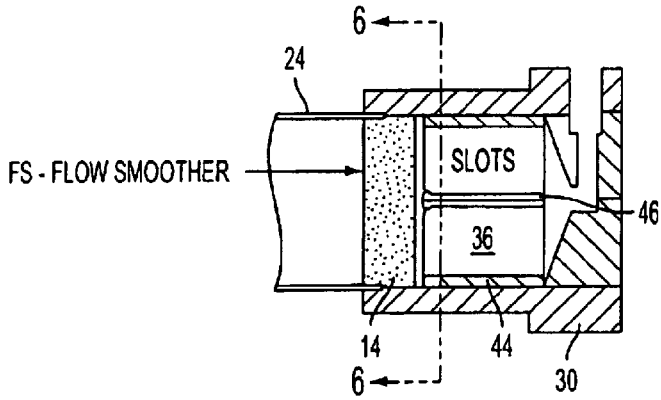
FIG. 5 fragmentarily illustrates a combination of a pulse tube and slotted heat exchanger with a screen flow smoother in accordance with the invention.

As illustrated in FIGS. 5 and 6, a slotted heat exchanger 36 includes a core 44 having a central bore 46 and a plurality of very narrow radial slots 48 extending from the bore 46. The slots 48 are made in the core 44, for example, by electric discharge machining. A practical minimum width in the circumferential direction for the slots 48 by this known manufacturing process is approximately 0.014 inches.

Table I (FIG. 4) compares calculated performance of a slotted heat exchanger 32, 36 (FIGS. 1, 5, 6) with a stacked wire screen heat exchanger (not shown) for the cold end 20 of the first stage of a pulse tube expander 24 operating between 2.2 Mpa and 0.8 Mpa using helium gas and cycling at 2.4 Hz. The analysis used for Table I is described in greater detail in U.S. Pat. No. 4,781,033.

Note in Table I that the slotted heat exchanger has a significant advantage with low void volume and low pressure drop relative to a screen type heat exchanger that is sized to give about the same heat transfer temperature difference.

Figure 3:
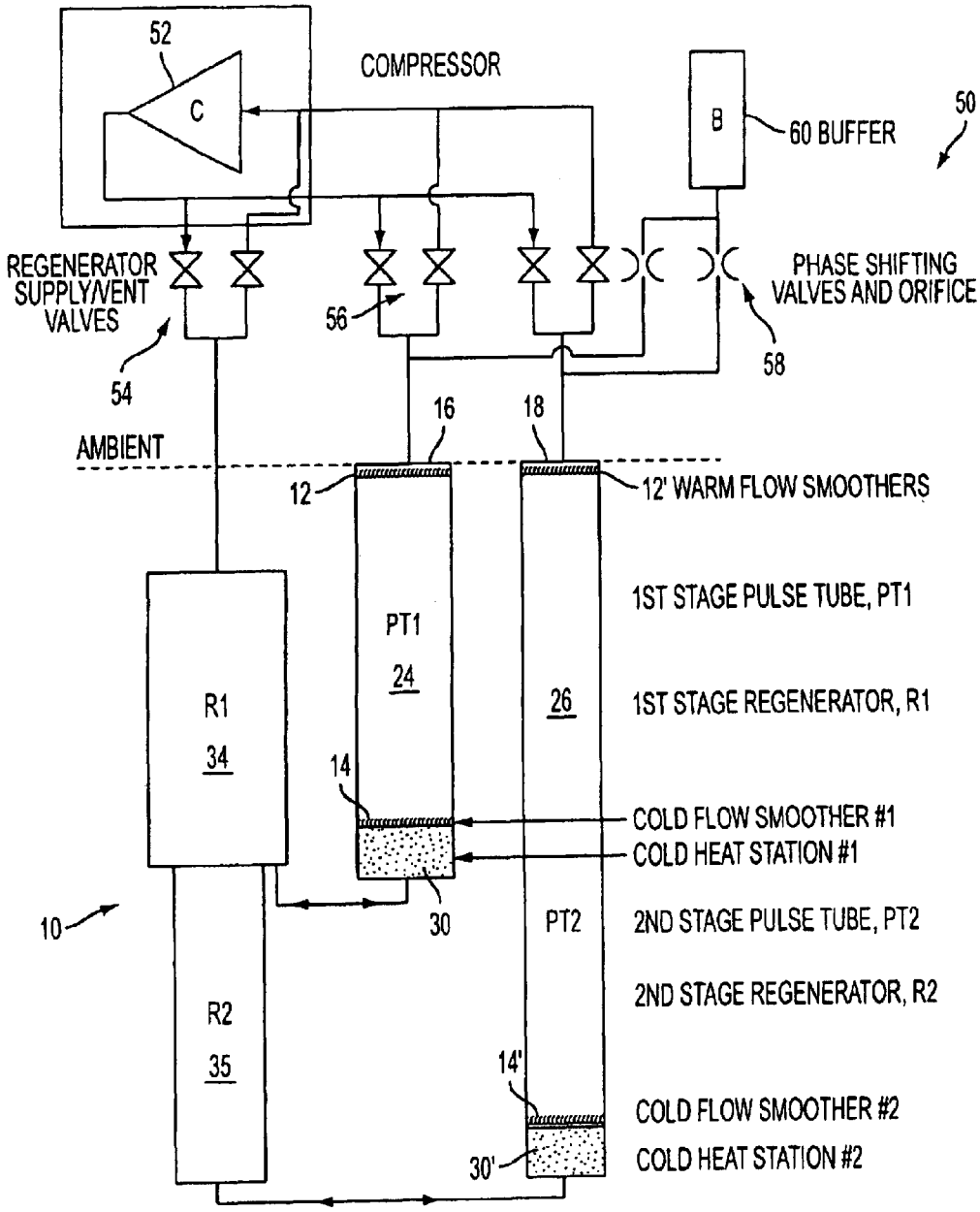
FIG. 3 is a schematic of a two stage pulse tube refrigeration system using flow smoothers in accordance with the invention.

FIG. 3 is a schematic of a two-stage pulse tube refrigeration system 50 that includes the two-stage pulse tube expander 10 of FIG. 1. The flow smoothers 12, 12', 14, 14' and heat stations 30, 30' are shown schematically relative to the pulse tubes 24, 26, regenerators 34, 35, compressor 52, valves 54 that cycle flow to the regenerators, phase-shifter valves 56,orifices 58 and buffer 60 that control the flow to the warm ends 16, 18 of the pulse tubes. Such a construction has achieved improved performance and is the subject of a pending patent application, which is the property of the assignee of the present application.

The flow smoothers in accordance with the invention can be used in any other pulse tube configuration, as shown for example in U.S. Pat. Nos. 5,107,683, 5,269,147, 5,335,505, 5,412,952, 5,481,878, 5,711,156, 5,711,157 and 6,094,921. These patents also show different locations for the heat exchangers at the warm and cold ends of the pulse tubes. Many show no heat exchanger at the warm end because the heat may be dissipated to ambient from the buffer volume or returned to the compressor with the warm gas that flows from the top end of the pulse tube through the phase shifting valves shown in FIG. 3.

It will thus be seen that the objectives set forth above, among those made apparent from the preceding description are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described.

What is claimed is:

1. A flow smoother for use with a pulse tube cryo-expander, comprising:

at least one first layer having a first plurality of first openings for flow therethrough, said at least one first layer being porous;

at least one second layer having a second plurality of second openings for flow therethrough, said at least one second layer being porous;

at least N layers having a plurality of openings for flow therethrough, said at least N layer being porous, where N has a value of 0, 1, 2, 3 . . . n;

said layers being in series for flow therethrough and joined together to form a rigidized structure and at least one of said layers being individually non-self supporting.

2. A flow smoother as in claim 1, wherein said at least one first layer is one of wire screen and wire felt.

3. A flow smoother as in claim 2, wherein said at least one second layer is one of wire screen and wire felt.

4. A flow smoother as in claim 3, wherein said at least N layers are one of wire screen and wire felt.

5. A flow smoother as in claim 3, wherein said wire screen and wire felt are metal, said layers being joined at wire contact points.

6. A flow smoother as in claim 4, wherein said wire screen and wire felt are metal and said layers are joined at wire contact points.

7. A flow smoother as in claim 1, wherein said series of layers in a flow direction are in a sequence of said at least one first layer, said at least one second layer, and said N layers in that order.

8. A flow smoother as in claim 2, wherein said first openings for flow are smaller in flow area than said second openings for flow, and said N layers have openings for flow greater in flow area than said first and second openings for flow.

9. A flow smoother as in claim 3, wherein said first openings for flow are smaller in flow area than said second openings for flow and said N layers have openings for flow greater in flow area than said first and second openings for flow.

10. A flow smoother as in claim 4, wherein said first openings for flow are smaller in flow area than said second openings for flow, and said N layers have openings for flow greater in flow area than said first and second openings for flow.

11. A flow smoother as in claim 7, wherein said first openings for flow are smaller in flow area than said second openings for flow, and said N layers have openings for flow greater in flow area than said first and second openings for flow.

12. A flow smoother as in claim 1, wherein at least some of said N layers have different total flow areas from others of said N layers.

13. A flow smoother as in claim 1, wherein a total flow area for each said layer increases in a flow direction from said at least one first layer to said N layers.

14. A flow smoother as in claim 2, wherein wires of said wire screen in said first layer are smaller cross section than a cross section of wires in said second layer, and said wires in said second layer are smaller in cross section than said wires in said N layers, said joining together providing said rigidized structure of layers.

15. A flow smoother for use with a pulse tube cryo-expander, comprising:

at least one first layer having a plurality of first openings for flow therethrough;

at least one second layer having a second plurality of second openings for flow therethrough;

at least N layers having openings for flow therethrough, where N has a value of 0, 1, 2, 3 . . . n;

said layers being joined together in a predetermined series to form a rigidized structure and at least one of said layers being individually non-self supporting.

16. A flow smoother as in claim 15, wherein said at least one first layer is one of wire screen and wire felt.

17. A flow smoother as in claim 16, wherein said at least one second layer is one of wire screen and wire felt.

18. A flow smoother as in claim 17, wherein said N layers are one of wire screen and wire felt.

19. A flow smoother as in claim 17, wherein said wire screen and said wire felt are metal, said layers being joined at points of mechanical contact between said wires.

20. A flow smoother as in claim 18, wherein said wire screen and wire felt are metal, said layers being joined at points of mechanical contact between said wires.

21. A flow smoother as in claim 15, wherein said layers are in series in an order of said at least one first layer said at least one second layer, and said N layers.

22. A flow smoother as in claim 18, wherein said layers are in series in an order of said at least one first layer, said at least one second layer and said N layers.

23. A flow smoother as in claim 21, wherein said at least one first layer has the smallest flow openings, and said N layers have openings larger than said openings in said at least one second layer.

24. A flow smoother as in claim 15, wherein each layer of said at least N layers has the same size flow openings.

25. A flow smoother as in claim 15, wherein at least one layer of said at least N layers has flow openings different from said flow openings in other layers of said at least N layers.

26. A flow smoother as in claim 15, wherein at least one said first layer is located between at least one said N layers and at least one said second layer.

27. A flow smoother as in claim 15 wherein said first layers, second layers and N layers are intermixed with each other in said series.

28. A flow smoother as in claim 15 wherein all of said at least one first layers are adjacent to each other, all of said at least one second layers are adjacent to each other, and all of said N layers are adjacent to each other.

29. An expander assembly for a cryogenic refrigeration system, comprising:

a cylindrical pulse tube having a warm end and a cold end; and a first flow smoother having a first face and a second face, said first face being connected to one said end of said pulse tuber said first flow smoother including:

at least one first layer having a first plurality of first openings for flow therethrough;

at least one second layer having a second plurality of second openings for flow therethrough;

at least N layers having openings for flow therethrough, where N has a value of 0, 1, 2, 3 . . . n;

said layers being joined together in a predetermined series to form a rigidized structure and at least one of said layers being individually non-self supporting.

30. An expander assembly as in claim 29, wherein said at least one first layer is one of wire screen and wire felt.

31. An expander assembly as in claim 30, wherein said wire screen and said wire felt are metal, said layers being joined at points of mechanical contact between said wires.

32. An expander assembly as in claim 29, wherein said first flow smoother and said pulse tube are connected by one of direct abutment and at least partial nesting of said flow smoother inside said pulse tube.

33. An expander assembly as in claim 29, further comprising a first heat exchanger, said first heat exchanger being flow connected to said second face of said first flow smoother by one of direct connection and a connecting flow path.

34. An expander assembly as in claim 33, wherein said first heat exchanger is one of a screen type and a radial slot type construction.

35. An expander assembly as in claim 31, further comprising a second flow smoother connected at said other end of said pulse tube, said second flow smoother having a first face connected to said pulse tube and a second face.

36. An expander assembly as in claim 35, further comprising:

a first heat exchanger, said first heat exchanger being flow connected to said first flow smoother at said one end of said pulse tube by one of direct connection and a connecting flow path;

a second heat exchanger, said second heat exchanger being flow connected to said second flow smoother at said other end of said pulse tube by one of direct connection and a connecting flow path.

37. An expander assembly as in claim 29, wherein said layers are in series in an order of said at least one first layer, at least one second layer, and said N layers.

38. An expander assembly as in claim 37, wherein said at least one first layer has the smallest flow openings, and said N layers have openings larger than said openings in said at least one second layer.

39. An expander assembly as in claim 38, wherein said at least one first layer is closest of said layers to said first base of said first flow smoother.

* * * * *